United States Patent [19]

Rasmussen

[11] 4,393,910

[45] Jul. 19, 1983

[54] FLEXIBLE CONTAINER HAVING FOUR LIFTING LOOPS

[75] Inventor: Odd F. Rasmussen, Porsgrunn, Norway

[73] Assignee: Norsk Hydro A.S., Oslo, Norway

[21] Appl. No.: 308,855

[22] Filed: Oct. 5, 1981

[30] Foreign Application Priority Data

Oct. 29, 1980 [NO] Norway ..... 803222

[51] Int. Cl.[3] ..... B65D 33/14

[52] U.S. Cl. ..... 150/12; 150/1; 229/54 R; 229/55; 428/35

[58] Field of Search ..... 229/54 R, 55; 150/1, 150/12; 428/35

[56] References Cited

U.S. PATENT DOCUMENTS

| | | | |
|---|---|---|---|
| 4,010,784 | 3/1977 | Nattrass et al. | 150/12 |
| 4,136,723 | 1/1979 | Skaadel et al. | 229/54 R |
| 4,191,229 | 3/1980 | Skaadel et al. | 150/1 |
| 4,233,709 | 9/1980 | Myklebust | 229/55 |
| 4,269,247 | 5/1981 | Omdal | 229/54 R |
| 4,300,608 | 11/1981 | Cuthbertson | 229/54 R |
| 4,356,853 | 11/1982 | Sekiguchi | 150/1 |

FOREIGN PATENT DOCUMENTS

| | | | |
|---|---|---|---|
| 102164 | 7/1965 | Denmark | 229/54 R |

*Primary Examiner*—William R. Dixon, Jr.

*Attorney, Agent, or Firm*—Wenderoth, Lind & Ponack

[57] ABSTRACT

The invention relates to flexible containers for lifting, transport and storage of bulk material and comprises lifting loops, an inlet opening, sidewalls and a bottom. Such containers can be used for transport and storage of large articles like 50 kilo bags, but also for free-flowing material. Easy loading and unloading into railroad cars, trucks and the like can be obtained by using this container. The container has four integrated lifting loops which are direct extensions of the container's sidewalls, and each lifting loop has a width of up to ¼ of the container's circumference. The container's bottom is preferably made from the extension of at least one of the sidewalls.

3 Claims, 3 Drawing Figures

FLEXIBLE CONTAINER HAVING FOUR LIFTING LOOPS

BACKGROUND OF THE INVENTION

The present invention relates to a flexible container for lifting, transport and storage of bulk material. The container comprises integrated lifting loops, at least one filling opening, sidewalls and a bottom.

For transport and storage of bulk material there are known several different types of containers. Regarding containers having integrated lifting loops, reference is made to Norwegian Pat. Nos. 136.744, corresponding to U.S. Pat. No. 4,269,723, and 138.134, corresponding to U.S. Pat. Nos. 4,191,229 and 4,136,723. These containers can be made with two lifting loops. Each of them has a width corresponding to half of the container's circumference. The first U.S. patent describes a container having a single layer bottom. The latter two U.S. patents primarily are related to a bottom construction formed by joining in pairs equally wide bottom flaps which are direct extensions of the container's walls. In this way there can be formed a substantially square double bottom of two crossing bottom loops.

There also exist several types of flexible containers, having their lifting loops sewn onto the container. European patent application No. 1696 relates to such a container having four lifting loops fastened to each corner of a substantially square container, and having a filling opening which has about the same area as the container's bottom. The lifting loops are made from narrow strips folded to form loops having two parts going downward, and at least one of these parts has the same length as the height of the container. Because the container has a large inlet opening, it may be equipped with a top covering or lid having a smaller filling opening. This lid is sewn to the container's sidewalls all the way around its circumference. However, this container does not possess the advantages resulting from application of integrated lifting loops and a double bottom. Containers according to the previously mentioned Norwegian and U.S. patents have proved themselves to be well suited for transport and storage of free-flowing bulk material and they are used for several different purposes. An essential reason for this success has been the simple construction comprising integrated lifting loops. However, these containers also have their limitations, especially during loading into large containers or railroad cards. Further, their construction is not quite ideal for filling large articles like 50 kilo bags for further transport and storage in the flexible containers.

SUMMARY OF THE INVENTION

The main object of the present invention was to develop a flexible container having lifting loops which made it possible to lift or hang the container onto several holding devices or points in order to obtain a container which could be loaded easily into railroad cars, trucks or the like.

A further object was to develop a container suitable for transport of large articles. Such flexible containers should during the filling operation possess a large inlet opening in order to make it applicable for other types of goods than free-flowing bulk material.

The inventor found that both these objects could be fulfilled by minor amendments of the basic construction of the containers according to the abovementioned Norwegian U.S. patents. Even the new container could be made from one piece of material folded together. By splitting such a piece of material over about half its length and then folding backwards the two narrow parts, it was surprisingly found that then half a container with two loops was formed. By applying two such pieces of material one could make a container having four integrated lifting loops, one in each corner of the container. All the strength in the direction of the longitudinally running threads of the container's material is utilized during the lifting operation, and simultaneously one obtained such short lifting loops that the container could easily be loaded into partially closed cars or wagons. One could for instance put two lifting loops on each of the lifting forks of a truck. During the filling operation the container would be hanging by each of its four loops, so that the inlet opening approximately corresponded to the container's circumference. Hanging up the container in such a way can be an advantage during filling of large articles such as small bags and also during filling of freeflowing bulk material. However, in the latter case it will usually be most advantageous to apply an inner bag of impervious material.

The container can be made in several ways. The simplest way of making it is to use two pieces of material of the same size. Each of them is doubled and then a slit is made longitudinally over about half their length for forming the two lifting loops. Two such pieces of material are sewn together for forming a container with four integrated lifting loops and having a double or single layer bottom, all depending on the length of the material pieces. It is even simpler to make a container of four pieces of material, each having a width corresponding to $\frac{1}{4}$ of the container's circumference. After having sewn together these pieces of material each of them forms a lifting loop.

BRIEF DESCRIPTION OF THE DRAWINGS

The container itself and its manufacture will now be further explained, with reference to the accompanying drawings.

DETAILED DESCRIPTION OF THE INVENTION

Figure 1:
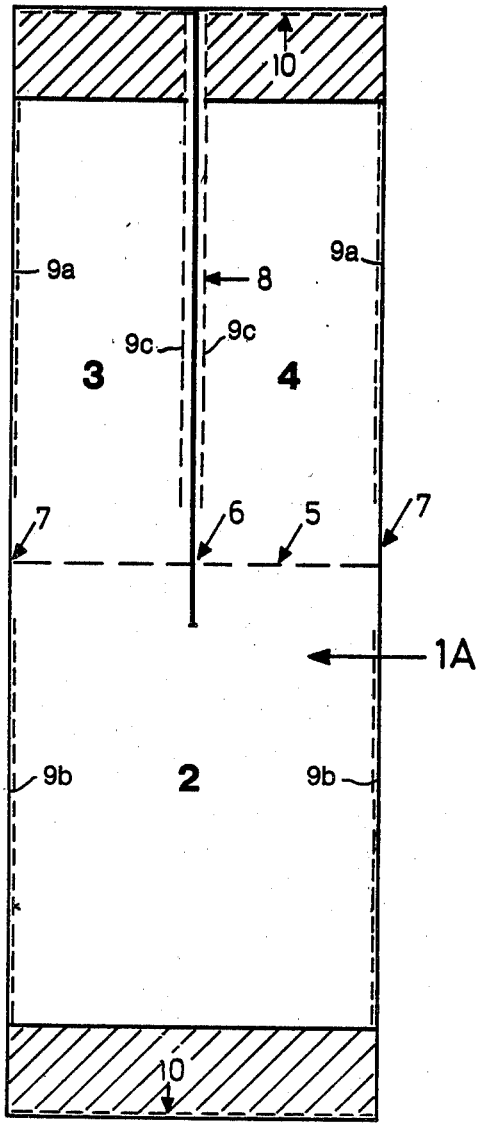
FIG. 1 shows one of two equally large pieces of material for making the container shown in FIG. 3.
Figure 2:
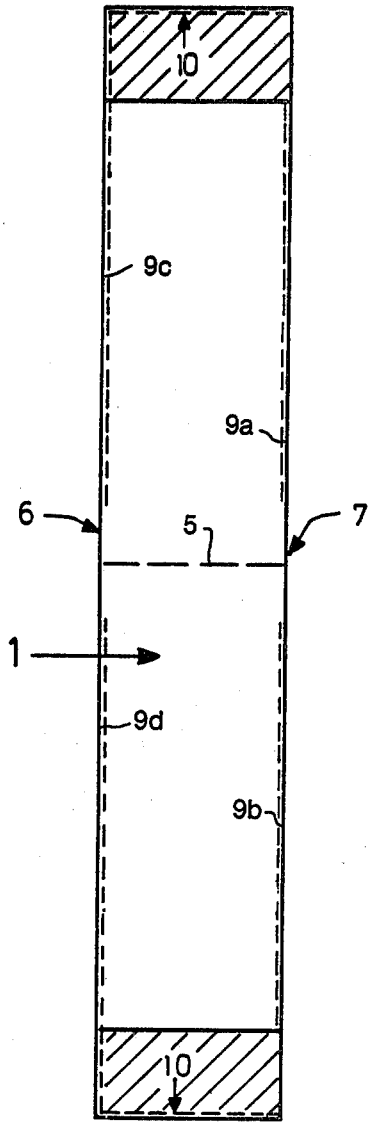
FIG. 2 shows one of four equally large pieces of material for making the container shown in FIG. 3.

The pieces of material shown in FIGS. 1 and 2 may of course be made from several pieces of material which are joined together, for instance two parts which are joined along the shown folding line. The pieces of material shown in FIGS. 1 and 2 can also be double ones, for instance parts of a round-woven fabric which is then formed to a flat piece of material. In this case it is not necessary to use as dense warp as in the case of a single layer fabric.

FIG. 1 shows a piece of material 1A which corresponds to a piece of material 1B (not shown), and the container is made by joining together the pieces 1A and 1B. The piece of material 1A consists of the parts 2, 3 and 4 defined by the folding line 5 and the slit 8 which divides one half of 1A into two equally wide pieces 3 and 4. The slit 8 extends longitudinally across the folding line 5, so that its extension forms the filling opening 6 shown in FIG. 3. On both sides of the slit 8 are joining lines 9c marked with dots up to the opening 6. Dotted lines 9a and 9b along the outer edges of the piece of material runs from openings 7 to the bottom flaps shown hatched with dotted joining lines 10. In case the container is to be made with a single layer bottom, one of the pieces of material 1A or 1B can be made without the hatched bottom flap.

Figure 3:
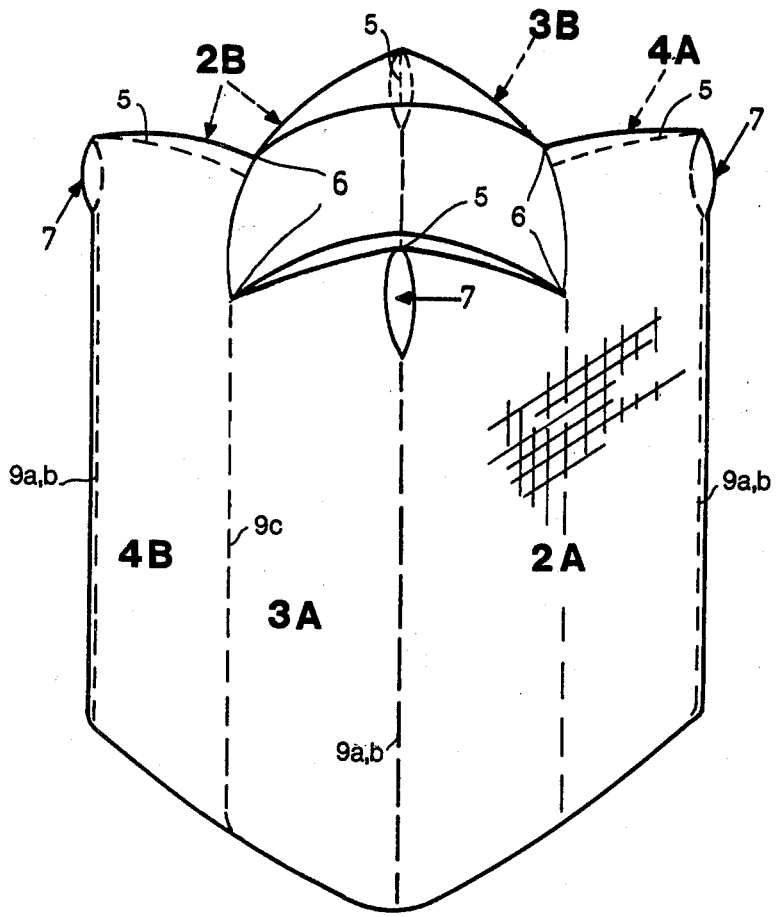
FIG. 3 is a perspective view of a flexible container with four lifting loops.

FIG. 2 shows one out of four equally wide pieces of material 1 for making a container according to FIG. 3. Two of the dotted joining lines 9a and 9b run from the openings 7 to the hatched bottom part, while two opposing joining lines 9c and 9d run from the previously mentioned openings and all the way down to the joining line 10 at the bottom. Each piece of material 1 is folded along a respective fold line 5 and forms a lifting loop having a width corresponding to ¼ of the container's circumference. Two pieces of material are joined along respective lines 9d, thereby forming a piece like piece 1A in FIG. 1. Then the pieces of material are joined along the respective lines 9a and 9b and 10. Thereby there is formed a container having a double layer bottom and four integrated lifting loops defined by the filling opening 6 and the loop openings 7 (FIG. 3). In the case that two of the material pieces 1 do not have the hatched bottom parts, there will be formed a container having a single layer bottom when the pieces of material are joined together. The bottom of the container may also consist of a separate piece of material joined to the container's sidewalls.

FIG. 3 shows a container made from pieces of material shown in FIGS. 1 and 2. When the container is made from the pieces of material 1A and 1B, it will have six side seams. When it is made from four pieces of material 1, it will have eight side seams. In order to explain how the pieces of material 1A and 1B are joined together, the parts 2, 3 and 4 on FIG. 1 are shown with reference to the pieces of material A and B. Each piece 1A and 1B has the seams 9a thereof joined to the seams 9b thereof. The pieces of material 1A and 1B then are joined along the seams 9c. The resultant container then has front side walls (as viewed in FIG. 3) 4B, 3A, 2A and rear side walls 2B, 3B, 4A.

When the container is made ready for being placed in position for filling, or for further transport, it might be an advantage to fasten a tape or the like around each lifting loop. It will then be easier to put the lifting loops on to hooks or a fork device. Further it will then be simpler to put three or four lifting loops on to a hook. When the container is made ready for being lifted by the hook, it might be an advantage to fasten together all the four lifting loops.

The container according to the invention has made it possible to further extend the application of flexible containers having integrated lifting loops. Such containers can easily be filled both with free-flowing bulk material and large articles. A maximum utilization of the container's volume is obtained at the same time as it becomes possible to lift the container with devices which can be used during loading and unloading of partly closed wagons. The stress during lifting will be evenly distributed and the strength of the container's longitudinally running threads will be utilized at its maximum.

I claim:

1. In a flexible container for the lifting, transportation and storage of bulk material, said flexible container including a bottom, plural side walls, an inlet opening and lifting loops, the improvement wherein:

said flexible container comprises four said lifting loops;

each said lifting loop comprises an integral extension of the material of at least portions of said side walls;

each said lifting loop has a width of no more than approximately one-quarter of the circumference of said container; and said bottom is formed from an integral extension of the material of at least one of said side walls.

2. The improvement claimed in claim 1, wherein said container is formed from two pieces of material, each said piece of material having a major longitudinal dimension and having a slit extending in said major longitudinal dimension over slightly more than half the length thereof, thereby forming an unslit first portion and second and third portions integral with said first portion and laterally separated from each other by said slit, said first portion having opposite lateral first side edges, said second and third portions each having an outer lateral second side edge and an inner lateral third side edge, each said piece of material being folded in half along a fold line extending transverse to said major longitudinal dimension, said outer lateral second side edges of said second and third portions being joined to respective of said lateral first side edges of said first portion to form two side seams spaced from said fold line, thereby forming two said lifting loops, and said inner lateral third side edges of said second and third portions of one said piece of material being joined to corresponding inner lateral third side edges of the other said piece of material to form two side seams, thereby forming said flexible container with four said lifting loops and six side seams.

3. The improvement claimed in claim 1, wherein said container is formed from four pieces of material, each said piece of material having a major longitudinal dimension and being folded in half along a fold line extending transverse to said major longitudinal dimension, thereby forming first and second portions each having opposite lateral first and second side edges, said first side edges of said first and second portions being joined to form a side seam spaced from said fold line, thereby forming one said lifting loop, and said second side edges of said first and second portions of each said piece of material being joined to similar second side edges of the first and second portions of two adjacent pieces of material, thereby forming said flexible container with four said lifting loops and eight side seams.

* * * * *